United States Patent [19]

Robertson

[11] 3,986,615

[45] Oct. 19, 1976

[54] IRONING BOARD HOLDER

[75] Inventor: Harry Robertson, Weston, Canada

[73] Assignee: Lawrence Peska Associates, Inc., New York, N.Y. ; a part interest

[22] Filed: May 6, 1975

[21] Appl. No.: 574,916

[52] U.S. Cl. ..... 211/86; 24/73 A; 248/499

[51] Int. Cl.[2] ..... A47F 5/00; A44B 21/00

[58] Field of Search ..... 211/86, 87, 89, 41, 211/13; 248/499, 203, 204, 201; 24/73 A, 81 AG, 81 AF, 81 BA, 81 CC, 81 SK, 81 A

[56] References Cited

UNITED STATES PATENTS

| | | | |
|---|---|---|---|
| 416,264 | 12/1889 | Hurlburt | 248/499 |
| 1,483,255 | 2/1924 | Tonge | 24/81 AF X |
| 1,508,643 | 9/1924 | Brokaw | 24/73 A |
| 2,270,796 | 1/1942 | Hauser | 211/86 |
| 2,720,984 | 10/1955 | Gotowka | 211/89 X |
| 2,983,413 | 5/1961 | Verwers | 24/73 A X |
| 3,313,511 | 4/1967 | Koerner et al. | 248/499 |

*Primary Examiner*—Roy D. Frazier
*Assistant Examiner*—Terrell P. Lewis
*Attorney, Agent, or Firm*—Eugene V. Mandel

[57] ABSTRACT

An adjustable ironing board holder comprising adjustable spring loaded top and bottom clips for mounting to a door, and top and bottom board holding devices.

5 Claims, 5 Drawing Figures

IRONING BOARD HOLDER

BACKGROUND OF THE INVENTION

This invention relates to a device for the convenient and easy storage of an ironing board on a vertical surface. It is particularly suitable to installation on the inside of a linen or storage closet door where the space between the inside surface of the door and the closet shelves cannot be utilized.

Space saving devices such as this invention are necessary today due to the lack of storage space and the increasing number of appliances used in the home.

The ironing board is one of the most cumbersome appliances to store satisfactorily both from the standpoint of space and cleanliness. Using this device it can be easily stored off the floor, in clean condition, concealed from view behind a door or as heretofore mentioned, in a closet.

Years ago many homes were constructed with built-in ironing board closets but due to the numerous variety of designs of ironing boards which have been marketed over the years these are not considered a practical installation by builders today.

It can be seen from the construction of the device of this invention that it can be quickly and easily installed on any convenient door without the use of nails, screws, bolts or any hardware which would make it a permanent fixture or which might mar the surface of the door in any way.

This invention is particularly advantageous to those who rent homes, rooms or apartments where, due to law or building regulations, the mounting or installing of any fixture with the use of nails, screws or bolts is prohibited.

It is unique in that it adjusts to fit any length of door and any size ironing board.

This invention is an asset to the housewife due to its light construction and ease of installation which enables it to be installed or removed when a more suitable location is required.

The purpose of this invention is to provide an easy device for storing a cumbersome portable collapsible ironing board.

The essence of this invention is an adjustable vertically mounted pair of clips.

Further objects and advantages of this invention will appear more clearly from the following description of a nonlimiting illustrative embodiment and the accompanying drawings in which like numerals designate like parts throughout the several views.

The features and details of the device of this invention may be more readily understood from a description of the accompanying drawings which are part of this application. Attached are drawings showing different views of the device of this invention.

DESCRIPTION OF TYPICAL EMBODIMENT

Figure 5:
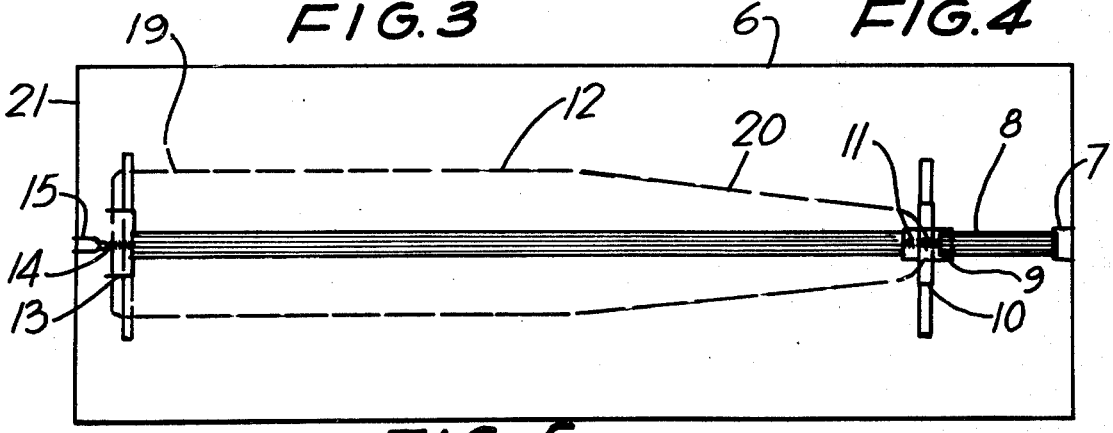
FIG. 5 shows the front elevation of the device of this invention firmly holding an ironing board in position on the back of a door.

In FIG. 5, an ironing board 12 can be seen raised off the floor and held firmly in position on the back of a door 6. It can be seen from the drawing that the wide end of the ironing board 19 is held and supported off the floor by the pre-shaped wire holder 13 which is sewn to the bottom end of the binding tape 8. The top or narrow end of the ironing board 20 is held in position by the adjustable wire holder 9, spring 11 and clamp 10 which hold the ironing board parallel with the door and prevent any sideways or outward movements of the ironing board when the door is opened or closed. In turn, the device of this invention, is mounted to the door by means of a U-shaped top clip 7 which is attached to the binding tape 8 and hooked over the top edge of the door 6. The bottom U-shaped clip 15, as seen in the drawing, is attached to one end of a spring 14, the other end of said spring being fastened to the bottom end of the binding tape 8 and wire holder 13. The bottom U-shaped wire clip 15 is moved downward and hooked under the bottom edge of the door 21 and in so doing the spring expands applying an even and constant pressure over the whole length of the tape keeping it firmly and securely in place on the door.

Figure 1:
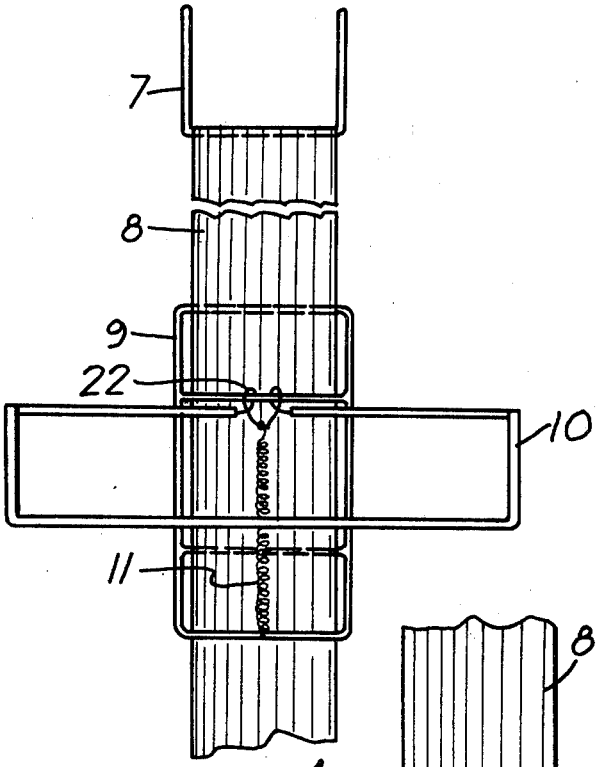
FIG. 1 shows a front view of the upper clamp assembly.
Figure 2:
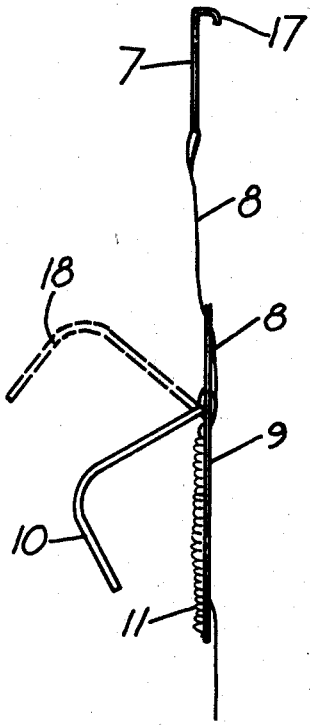
FIG. 2 shows a side view of FIG. 1.

FIG. 1 shows an upper front elevation of this invention. At the top is the wire clip 7 shaped in such a way as to form a U, the two outside perpendicular ends of the U being bent to form a hook 17 which when installed is placed over the top edge of the door. FIG. 2 also shows the end of the binding tape 8 wrapped over the horizontal cross member of the U-shaped wire clip 7 and attached and hemmed with nylon thread. The adjustable wire holder 9 can be observed more clearly in this drawing and the binding tape interwoven through its horizontal cross members is much more apparent. It can be seen from the drawing that the adjustable wire holder 9 may be raised or lowered to any desired position on the tape 8 therefore facilitating any sized ironing board. The wire clamp 10 is also shown bent around the horizontal cross member of the wire holder 9 in such a way as to form a hinge and a loop 22 of itself as can be seen from the side elevation of the wire clamp 10 it may be raised or lowered through an arc of 180 to position 18. A spring 11 running parallel with the binding tape with one end hooked as shown to the loop in the wire clamp 22 and the other end attached to the lower horizontal cross member of the wire holder 9 applies a constant downward pressure on the wire clamp 10, thus keeping said wire clamp in place over the adjustable feet or edge of the ironing board depending upon the type and style used. It can also be seen from the drawing that the spring 11 applies pressure against the binding tape 8, holding it in turn tightly against the horizontal cross member of the wire holder 9. It is this constant tension from the spring 11 which prevents the adjustable wire holder 9 from sliding down the tape when the ironing board 12 is removed from the device of this invention. The wire clamp 10 is pre-formed and shaped in such a way as to be adaptable to clamp various styles and designs of ironing boards and varying adjustable legs. The wire may be a covered one with plastic tubing so that there is no danger of scratching the ironing board when the latter is clamped into place.

Figure 3:
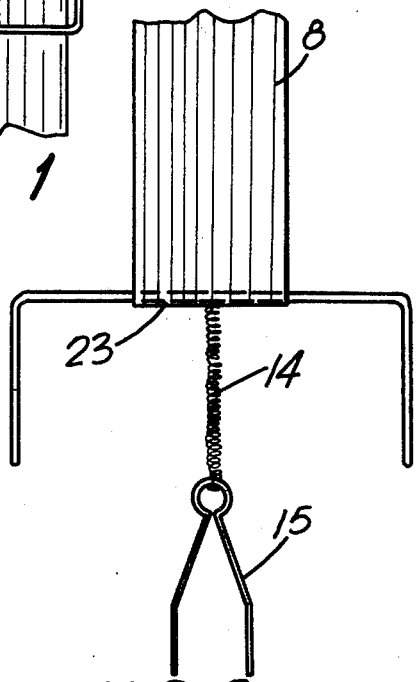
FIG. 3 shows a front view of the lower holder assembly.
Figure 4:
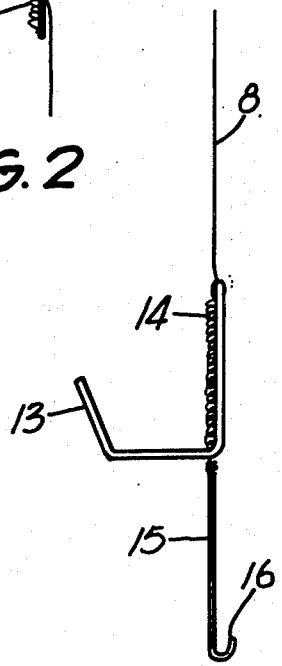
FIG. 4 shows a side view of FIG. 3.

FIG. 3 shows the lower front view of this invention. A hole is punched in the centre of the binding tape 8 1 inch from its end. One end of the spring 14 is inserted through the hole and looped over the horizontal cross member of the bottom wire holder 13. The end 23 of the binding tape is then wrapped around the said horizontal cross member of the wire holder 13 amd hemmed with nylon thread. The bottom wire holder 13 is formed and shaped in such a way as to form two hooks directly opposite and parallel to each other. These hold the wide bottom edge of the ironing board. This wire may also be covered with plastic to prevent damage to the ironing board during storage. The other end of the aforementioned spring 14 is attached to the preformed bottom clip 15 of which the ends of its perpendicular sides are bent to form two hooks 16 the shape of which are readily seen on the side elevation drawing FIG. 4. When the said bottom clip 15 is hooked under the lower edge of the door as shown, it expands the spring 14 applying tension throughout the length of the binding tape thus keeping an even and constant pressure on the top and bottom clips and preventing any loosening of the assembly. The spring 14 compensates for any stretching of the binding tape 8 due to variations in the weight of ironing boards and variation in height of doors. It is apparent from the materials used and the design of this invention that it may be folded into a very compact package for ease of carrying and handling and may easily be installed by the housewife in a matter of seconds.

To install — simply place the top wire clip 7 over the top edge of the door — grasp the bottom wire clip 15 and hook under the bottom edge of the door. To store the board — fold the legs in the usual manner — lift the board up parallel with the door placing the wide lower edge of the board into the protruding hooks of the wire holder 13 — raise the wire clamp 10 and push the ironing board forward against the door. When the wire clamp 10 is released the spring contracts pulling the wire clamp down over the top narrow end of the ironing board as in FIG. 5 — or over the top horizontal surface of adjustable wooden or metal legs, whichever the case may be, depending upon the type of ironing board used.

The invention includes all novelty residing in the description and drawings. It is obvious to those skilled in the art that various minor changes can be made without departing from the concept of this invention and all such as fall within the reasonable scope of the appended claims are claimed.

What is claimed is:

1. An ironing board holder comprising a tape to which is adjustably mounted top board holding means including a spring actuated clamp, and to which is also mounted bottom board holding means comprising a metal hook; one end of said tape being attached to a mounting clip formed to engage over the top of a door or the like; the other end of said tape being attached via a spring to a clip adapted to engage under the bottom of a door; the clips oriented for mounting on a door in a direction opposite to that of the clamp and hook for holding the board.

2. In a device as in claim 1, the clamp is pivoted.

3. In a device as in claim 1, at least some of the parts being bent up from metal wire.

4. In a device as in claim 1, at least some of the board contacting parts being covered with soft material to protect from marring.

5. In a device as in claim 1, at least some of the mounting to the tape being accomplished by stitching.

* * * * *